US006796295B2

(12) United States Patent
Kidokoro et al.

(10) Patent No.: US 6,796,295 B2
(45) Date of Patent: Sep. 28, 2004

(54) EVAPORATED FUEL TREATMENT DEVICE FOR INTERNAL COMBUSTION ENGINE

(75) Inventors: Toru Kidokoro, Torrance, CA (US); Takuji Matsubara, Yokosuka (JP); Yoshihiko Hyodo, Gotemba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/700,568

(22) Filed: Nov. 5, 2003

(65) Prior Publication Data

US 2004/0089275 A1 May 13, 2004

(30) Foreign Application Priority Data

Nov. 5, 2002 (JP) ..... 2002-321688

(51) Int. Cl.[7] ..... F02M 33/00
(52) U.S. Cl. ..... 123/520
(58) Field of Search ..... 123/516, 518, 123/519, 520

(56) References Cited

U.S. PATENT DOCUMENTS 5,429,097 A * 7/1995 Wojts-Saary et al. ..... 123/520
6,105,556 A * 8/2000 Takaku et al. ..... 123/520
6,405,718 B1 * 6/2002 Yoshioka et al. ..... 123/520
2004/0103886 A1 * 6/2004 Benjey ..... 123/520

FOREIGN PATENT DOCUMENTS

| | | |
|---|---|---|
| JP | 05-332210 | 12/1993 |
| JP | 2001-041114 | 2/2001 |
| JP | 2001-165003 | 6/2001 |

* cited by examiner

*Primary Examiner*—Thomas Moulis
(74) *Attorney, Agent, or Firm*—Kenyon & Kenyon

(57) ABSTRACT

A vapor passage 20 that makes communication between a fuel tank 10 and a canister 26 is provided. A purge passage 34 that makes communication between the canister 26 and an intake passage 38 of an internal combustion engine is provided. A sealing valve 28 that controls a communication state of the vapor passage 20 and a purge VSV 36 that controls a communication state of the purge passage 34 are provided. A tank internal pressure sensor 12 detects tank internal pressure Pt. The purge VSV 36 is controlled to purge evaporated fuel into the intake passage 38 during operation of the internal combustion engine. The sealing valve 28 is opened/closed depending on whether a predetermined purge is performed in an area where the tank internal pressure Pt is positive.

5 Claims, 9 Drawing Sheets

EVAPORATED FUEL TREATMENT DEVICE FOR INTERNAL COMBUSTION ENGINE

BACKGROUND OF THE INVENTION

1. Field of the Invention

The present invention relates to an evaporated fuel treatment device for internal combustion engine, and more particularly to an evaporated fuel treatment device for preventing evaporated fuel generated in a fuel tank from being released into the atmosphere.

2. Background Art

Japanese Patent Laid-Open No. 2001-165003,for example, discloses an evaporated fuel treatment device that includes a canister communicating with a fuel tank. This device has a sealing valve for tightly sealing the fuel tank in a path that makes communication between the fuel tank and the canister. The sealing valve is controlled in a closed state except during refueling. When a refueling operation is detected, the sealing valve is kept in an opened state during a time period between the detection and completion of the refueling.

Given that the sealing valve opens at the time when the refueling operation is detected, a gas in the tank containing evaporated fuel can be emitted toward the canister before a refueling port opens. If the sealing valve is kept opened during the refueling, the gas in the tank can be emitted toward the canister during the time, thus achieving good refueling properties. In such a situation, the canister adsorbs the evaporated fuel contained in the gas in the tank. This prevents the evaporated fuel from being released into the atmosphere as the gas in the tank is emitted.

Provided that the sealing valve is closed in situations other than the refueling, the evaporated fuel is prevented from flowing into the canister in such situations, thus allowing sufficient fuel adsorption space to be always left in the canister to provide for refueling. Therefore, the conventional device can minimize the capacity of the canister required for preventing the evaporated fuel from being released into the atmosphere during refueling, and avoid an increase in size of the canister.

However, in the conventional device, tank internal pressure may become excessively high while the sealing valve is closed. In a state where such high tank internal pressure is generated, it is necessary to open the sealing valve simultaneously with the detection of the refueling operation, and then prohibit opening of the refueling port for a long time until the tank internal pressure is sufficiently reduced, in order to prevent the evaporated fuel from being released into the atmosphere associated with the refueling. Thus, the conventional device effectively prevents the evaporated fuel from being released into the atmosphere, but requires a long waiting time before the refueling in order to make full use of its function.

Such a waiting time can be reduced by, for example, opening the sealing valve at a time when the tank internal pressure increases to a certain extent, and appropriately releasing the tank internal pressure toward the canister. If such a method is used, however, the canister adsorbs the evaporated fuel emitted from the fuel tank when the tank internal pressure is released, and insufficient adsorption space may be left in the canister when the refueling is performed. Thus, a combination of the conventional device and the above described method cannot allow reduction in the waiting time during the refueling while keeping good emission properties.

SUMMARY OF THE INVENTION

The present invention is achieved to solve the above described problem, and has an object to provide an evaporated fuel treatment device of an internal combustion engine that achieves good emission properties, and avoids a long waiting time before refueling, using a canister with a minimum capacity.

The above object of the present invention is achieved by an evaporated fuel treatment device of an internal combustion engine. The device includes a vapor passage that makes communication between a fuel tank and a canister. The device also includes a purge passage that makes communication between the canister and an intake passage of the internal combustion engine. A sealing valve is provided to the vapor passage for controlling a communication state thereof. A purge control valve is provided to the purge passage for controlling a communication state thereof. The device includes a tank internal pressure detection unit that detects tank internal pressure. The device also includes a purge control unit that controls the purge control valve to flow evaporated fuel into the intake passage during operation of the internal combustion engine. The device further includes a sealing valve synchronization control unit that opens or closes the sealing valve depending on whether a predefined purge is performed in an area where the tank internal pressure is positive.

Other objects and further features of the present invention will be apparent from the following detailed description when read in conjunction with the accompanying drawings.

BEST MODE OF CARRYING OUT THE INVENTION

Figure 1:
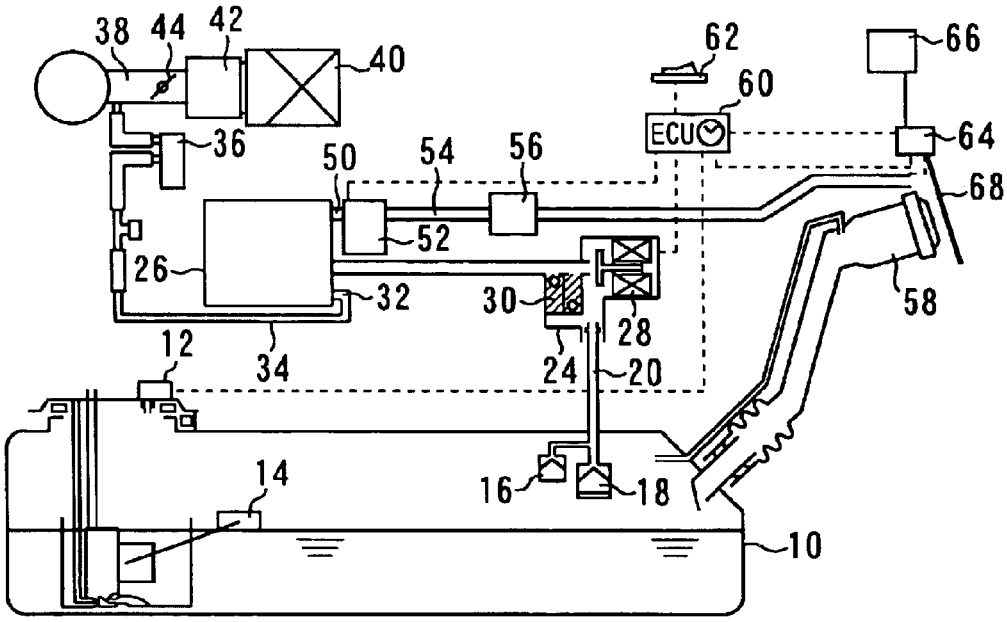
FIG. 1 is a drawing for describing a structure of an evaporated fuel treatment device according to a first embodiment of the present invention.

Now, embodiments of the present invention will be described with reference to the drawings. Like reference numerals denote like components throughout the drawings, and redundant descriptions will be omitted.

First Embodiment

Description of Structure of Device

FIG. 1 illustrates a structure of an evaporated fuel treatment device according to a first embodiment of the present invention. As shown in FIG. 1, the device according to the present embodiment includes a fuel tank 10. The fuel tank 10 has a tank internal pressure sensor 12 for measuring tank internal pressure Ptnk. The tank internal pressure sensor 12 detects the tank internal pressure Ptnk as relative pressure with respect to atmospheric pressure, and generates output in response to a detection value. A liquid level sensor 14 for detecting a liquid level of fuel is placed in the fuel tank 10.

A vapor passage 20 is connected to the fuel tank 10 via ROVs (Roll Over Valves) 16, 18. The vapor passage 20 has a sealing valve unit 24 on the way thereof, and communicates with a canister 26 at an end thereof. The sealing valve unit 24 has a sealing valve 28 and a pressure control valve 30. The sealing valve 28 is a solenoid valve of a normally closed type, which is closed in a nonenergized state, and opened by a driving signal being supplied from outside. The pressure control valve 30 is a mechanical two-way check valve constituted by a forward relief valve that is opened when pressure of the fuel tank 10 side is sufficiently higher than pressure of the canister 26 side, and a backward relief valve that is opened when the pressure of the canister 26 side is sufficiently higher than the pressure of the fuel tank 10 side. Valve opening pressure of the pressure control valve 30 is set to, for example, about 20 kPa in a forward direction, and about 15 kPa in a backward direction.

The canister 26 has a purge hole 32. A purge passage 34 communicates with the purge hole 32. The purge passage 34 has a purge VSV (Vacuum Switching Valve) 36, and communicates, at an end thereof, with an intake passage 38 of the internal combustion engine. An air filter 40, an airflow meter 42, a throttle valve 44, or the like are provide in the intake passage 38 of the internal combustion engine. The purge passage 34 communicates with the intake passage 38 downstream of the throttle valve 44.

The canister 26 is filled with activated carbon. The evaporated fuel having flown into the canister 26 through the vapor passage 20 is adsorbed by the activated carbon. The canister 26 has an atmosphere hole 50. An atmosphere passage 54 communicates with the atmosphere hole 50 via a negative pressure pump module 52.

The negative pressure pump module 52 has a negative pressure pump and a switching valve (both are not shown). The switching valve is a valve mechanism that can selectively achieve an atmosphere opening state where the atmosphere hole 50 of the canister 26 communicates with the atmosphere passage 54, and a negative pressure introduction state where the atmosphere hole 50 communicates with a suction hole of the negative pressure pump. The negative pressure pump module 52 can open the canister 26 to the atmosphere by switching the switching valve to the atmosphere opening state, and introduce negative pressure into the canister 26 by switching the switching valve to the negative pressure introduction state and operating the negative pressure pump.

As shown in FIG. 1, the evaporated fuel treatment device according to the present embodiment has an ECU 60. The ECU 60 includes a soak timer for counting an elapsed time during parking of a vehicle. A lid switch 62 and a lid opener opening/closing switch 64 are connected to the ECU 60 together with the tank internal pressure sensor 12, the sealing valve 28, and the negative pressure pump module 52. A lid manual opening/closing device 66 is connected to the lid opener opening/closing switch 64 using a wire.

The lid opener opening/closing switch 64 is a lock mechanism of a lid (lid of a body) 68 that covers the refueling port 58, and unlocks the lid 68 when a lid opening signal is supplied from the ECU 60, or when a predetermined opening operation is performed on the lid manual opening/closing device 66. The lid switch 62 connected to the ECU 60 is a switch for issuing an instruction to unlock the lid 68 to the ECU 60.

Description of Basic Operations

Next, basic operations of the evaporated fuel treatment device according to the present embodiment will be described.

(1) During Parking

The evaporated fuel treatment device according to the present embodiment generally keeps the sealing valve 28 in a closed state during the parking of the vehicle. When the sealing valve 28 is closed, the fuel tank 10 is separated from the canister 26 as long as the pressure control valve 30 is closed. Thus, in the evaporated fuel treatment device according to the present embodiment, the canister 26 adsorbs no more evaporated fuel during the parking of the vehicle, as long as the tank internal pressure Ptnk is lower than the forward direction valve opening pressure (20 kPa) of the pressure control valve 30. Similarly, the fuel tank 10 sucks no air during the parking of the vehicle, as long as the tank internal pressure Ptnk is higher than backward direction valve opening pressure (−15 kPa).

(2)During Refueling

In the device according to the present embodiment, the tank internal pressure Pt may become higher than atmospheric pressure during stop of the vehicle. If a tank cap is opened in such a state, the evaporated fuel in the fuel tank 10 tends to be released into the atmosphere. Thus, when the refueling is requested, that is, when the lid switch 62 is operated, during the stop of the vehicle, the device according to the present embodiment does not allow opening of the refueling port 58 until the tank internal pressure Pt is reduced.

Figure 2:
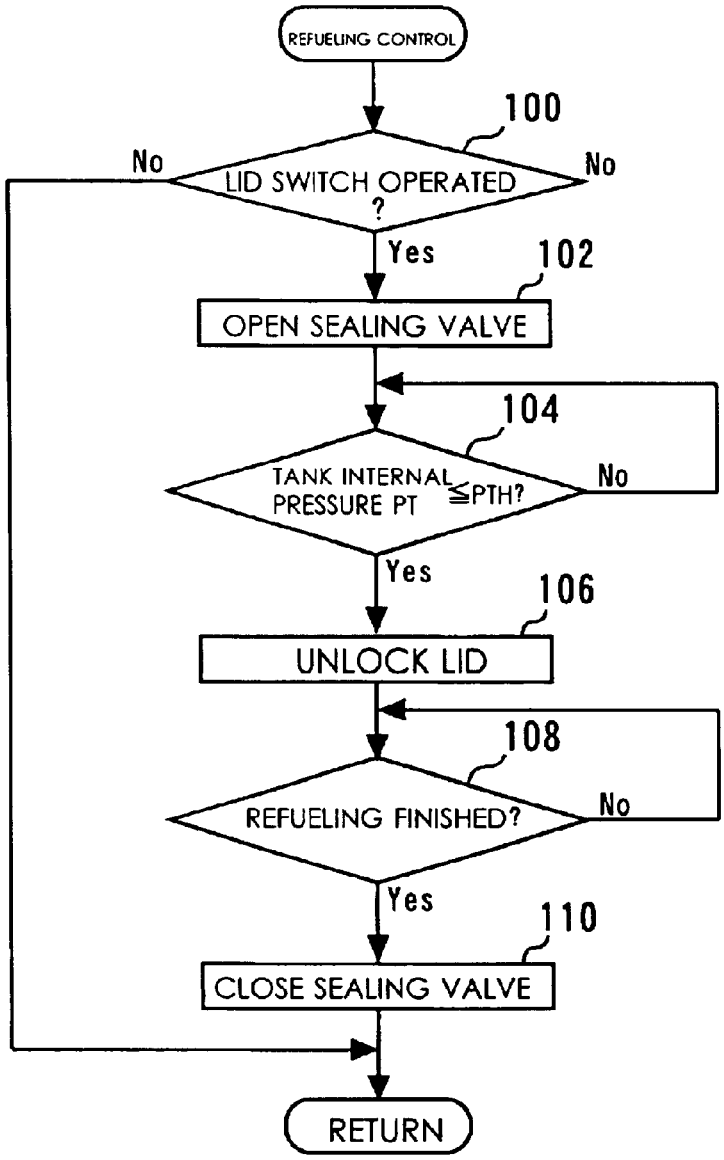
FIG. 2 is a flowchart of a refueling control routine performed by the device according to the first embodiment of the present invention.

FIG. 2 is a flowchart of a control routine performed by the ECU 60 for achieving the above described function. In this routine, it is first determined whether the lid switch 62 is operated (Step 100). The lid switch 62 is sometimes operated during the parking of the vehicle. Thus, the ECU 60 keeps a state where the ECU 60 can detect whether the lid switch 62 is operated (a standby state), even during the parking of the vehicle. Therefore, the ECU 60 can perform the processing of Step 100 even during the parking of the vehicle.

If there is no sign of the operation of the lid switch 62 in the processing of Step 100, the current processing cycle is finished. On the other hand, if there is a sign of the operation of the lid switch 62, the ECU 60 enters a normal operation state out of the standby state, and then making the sealing valve 28 open (Step 102).

Then, it is determined whether the tank internal pressure Pt is equal to or lower than determination pressure Pth (Step 104). When the tank internal pressure Pt is higher than the atmospheric pressure before the sealing valve 28 opens, the gas in the tank containing the evaporated fuel is emitted from the fuel tank 10 toward the canister after the sealing valve 28 opens, and thus the tank internal pressure Pt is substantially reduced to the atmospheric pressure. During this process, the evaporated fuel flowing into the canister 26 is adsorbed by activated carbon therein, and not released into the atmosphere. The processing of thus reducing the tank internal pressure Pt is hereinafter referred to as "decompression".

The tank internal pressure Pt can become lower than the determination pressure Pth used in Step 104 by the decompression, and as long as the tank internal pressure Pt is reduced to the determination pressure Pth, a large amount of evaporated fuel is not released into the atmosphere even if the refueling port 58 opens. In the routine shown in FIG. 2, the processing of Step 104 is repeatedly performed until it is determined that the condition of Pt≦Pth is satisfied. When the tank internal pressure Pt is reduced to the determination pressure Pth, and it is determined that the condition of Pt≦Pth is satisfied, the lid 68 is unlocked (Step 106).

When the lid 68 is unlocked, it becomes possible to open the lid 68, remove the tank cap, then start the refueling. In other words, in the routine shown in FIG. 2, the removal of the tank cap, that is, the opening of the refueling port 58 is prohibited until the tank internal pressure Pt is reduced equal to or lower than the determination pressure Pth. Thus, the device according to the present embodiment can effectively prevent the evaporated fuel from being released into the atmosphere through the refueling port 58 during the refueling.

In the routine shown in FIG. 2, it is then determined whether the refueling is finished (Step 108). Whether the refueling is finished or not can be determined depending on, for example, whether a detection value of the liquid level sensor 14 increasing as the refueling is performed is kept constant for a certain time period, or whether a closing operation of the lid 68 is detected.

The processing of Step 108 is repeatedly performed until a judgment is made that the refueling is finished. During this period, the sealing valve 28 is kept in the opened state. When the judgment is made that the refueling is finished, the sealing valve 28 is returned to the closed state (Step 110). For good refueling properties, it is necessary to emit the gas in the tank out of the fuel tank 10 as the refueling reduces the capacity of the fuel tank 10. The above described processing allows the gas in the tank to flow into the canister 26 during the refueling. When the gas in the tank flows into the canister 26, the canister 26 can adsorb the evaporated fuel in the gas, and emit air only into the atmosphere. Thus, the device according to the present embodiment can achieve good emission properties, and ensure good refueling properties.

(3)During Running

Description on Purge

As described above, the device according to the present embodiment allows the gas in the fuel tank 10 to be emitted toward the canister 26, and allows the evaporated fuel contained in the gas to be adsorbed by the activated carbon in the canister 26, during the refueling. The ECU 60 provides an appropriate degree of opening to the purge VSV 36 to purge the evaporated fuel adsorbed by the canister 26, during running of the vehicle (during operation of the internal combustion engine).

Specifically, if the purge VSV 36 opens during the operation of the internal combustion engine, suction negative pressure in the intake passage 38 is introduced into the canister 26. During the running of the vehicle, the atmosphere hole 50 of the canister 26 is generally opened to the atmosphere, and thus when such negative pressure is introduced into the canister 26, a flow of air sucked from the atmosphere hole 50 and moving toward the purge hole 32 occurs in the canister 26. Then, the evaporated fuel adsorbed in the canister 26 is separated from the activated carbon by the flow of air, and purged thereby flowing into the intake passage 38 through the purge passage 34. In the device according to the present embodiment, the evaporated fuel adsorbed by the canister 26 during the refueling can be thus purged thereby flowing into the intake passage 38 and treated without being released into the atmosphere.

Description on Control of Sealing Valve

As described above, the device according to the present embodiment unlocks the lid 68 after the lid switch 62 is operated and the fuel tank 10 is decompressed. Specifically, in the device according to the present embodiment, a waiting time required for decompression occurs between when the lid switch 62 is operated and when the refueling is actually allowed. A longer waiting time is required for higher tank internal pressure Pt at the time of the operation of the lid switch 62. Thus, it is necessary to prevent the tank internal pressure Pt from excessively increasing during the running of the vehicle, in order to avoid an uncomfortable feeling given to a user of the vehicle.

The tank internal pressure Pt can be kept near the atmospheric pressure by, for example, appropriately opening the sealing valve 28 at the time when the tank internal pressure Pt increases to a certain extent, and emitting the gas in the fuel tank 10 toward the canister 26. However, if the sealing valve 28 opens whenever the tank internal pressure Pt becomes high, due to the evaporated fuel emitted by the opening of the valve being adsorbed by the canister 26, insufficient adsorption space may be left in the canister 26 at the time when the refueling is requested.

In the device according to the present embodiment, when the internal combustion engine is operated and the purge VSV 36 opens, that is, when the evaporated fuel is purged, the suction negative pressure is introduced into the purge hole 32 of the canister 26. When the evaporated fuel flows into the canister 26 from the vapor passage 20 in the state where the suction negative pressure is introduced into the purge hole 32, the purged evaporated fuel flows directly into the purge passage 34 without being adsorbed by the activated carbon in the canister 26. Particularly, the canister 26 used in the present embodiment is configured so that the gas flowing into the canister 26 in such a state can flow into the purge passage 34 without passing through the activated carbon in the canister 26.

Thus, the amount of fuel adsorbed by the canister 26 does not significantly increase even if the evaporated fuel in the fuel tank 10 is emitted toward the canister 26 in a case where the purge of the evaporated fuel is performed in the device according to the present embodiment. Then, the device according to the present embodiment opens the sealing valve 28 synchronously with the performance of the purge when it is required to reduce the tank internal pressure Pt for shortening the waiting time before the refueling as the tank internal pressure Pt is positive.

Figure 3:
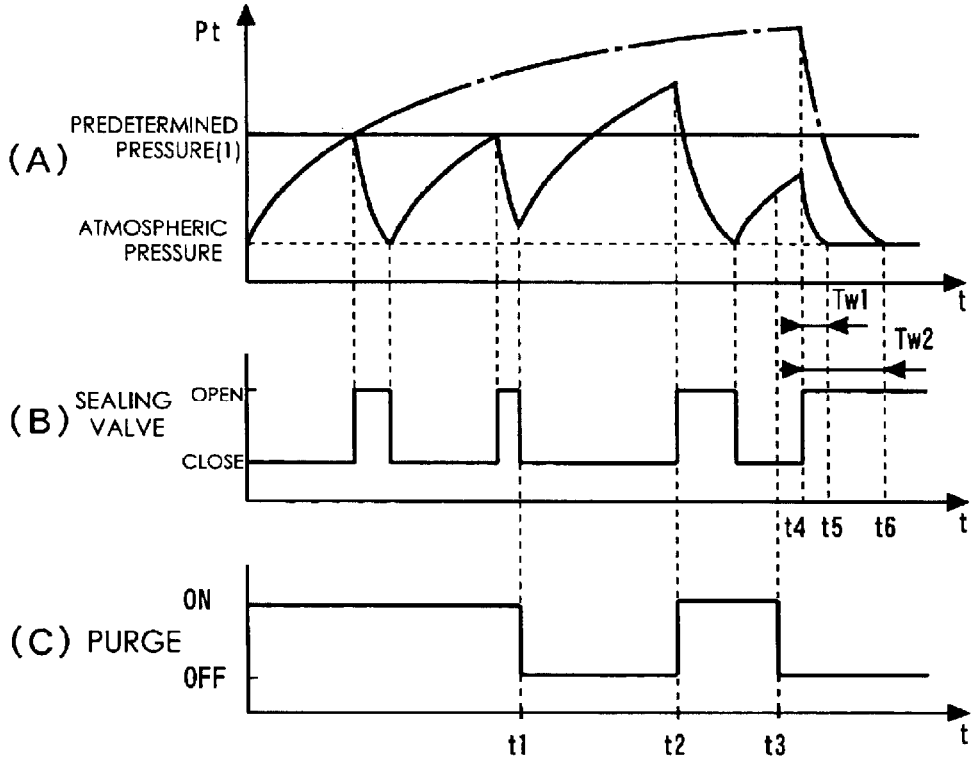
FIGS. 3A through 3C are timing charts for describing an operation of the device according to the first embodiment of the present invention.

FIGS. 3A through 3C are timing charts for illustrating an operation of the device according to the present embodiment achieved in a process where the vehicle moves from the running state to the parking state. More specifically, FIG. 3A shows a comparison between the tank internal pressure Pt (the solid line) achieved by the sealing valve 28 being appropriately opened/closed synchronously with the performance of the purge, and the tank internal pressure Pt (the single dot dashed line) achieved when the sealing valve 28 is always closed. FIG. 3B shows an opening/closing state of the sealing valve 28. Further, FIG. 3C shows a performing state of the purge.

In the example shown in FIGS. 3A through 3C, a period before time t1 shows a period in which the internal combustion engine operates as well as the evaporated fuel is purged into the intake passage 38. As shown in FIG. 3A and FIG. 3B, during this period, the sealing valve 28 opens when the tank internal pressure Pt reaches predetermined pressure (1) (>atmospheric pressure), whereas closing when the tank internal pressure Pt is then reduced to the atmospheric pressure. Thus, the tank internal pressure Pt (the solid line) is controlled between the predetermined pressure (1) and the atmospheric pressure, thereby sufficiently minimized compared with one generated when the sealing valve 28 is always closed (the single dot dashed line).

The time t1 shows a time when the purge is turned off during the running of the vehicle (during the operation of the internal combustion engine). As described above, the device according to the present embodiment opens the sealing valve 28 synchronously with the performance of the purge. Thus, the sealing valve 28 keeps the closed state at least until the purge is restarted after the time t1 (see FIG. 3B). Then, as shown in FIG. 3A, the tank internal pressure Pt sometimes becomes higher than the predetermined pressure (1) while the sealing valve 28 closes.

Time t2 is a time when the purge is restarted in the state where the tank internal pressure Pt exceeds the predetermined pressure (1). The device according to the present embodiment opens the sealing valve 28 in the state where the tank internal pressure Pt exceeds the predetermined pressure (1) and the purge is performed. The sealing valve 28 keeps the opened state until the tank internal pressure Pt is reduced to the atmospheric pressure after the time t2 as long as the purge is not turned off.

Time t3 is a time when the vehicle moves from the running state to the parking state, that is, a time when the internal combustion engine changes from an operating state to a non-operating state. The evaporated fuel cannot be purged unless the internal combustion engine operates. Thus, as shown in FIG. 3C, the purge is turned off (the purge VSV 36 is closed) at the time t3. As described above, the device according to the present embodiment closes the sealing valve 28 during the parking of the vehicle except during the refueling. Therefore, the sealing valve 28 keeps the closed state until the refueling is requested after the time t3.

In FIGS. 3A through 3C, time t4 is a time when the lid switch 62 is operated. When the lid switch 62 is operated, the sealing valve 28 moves from the closed state to the opened state as described above. Thus, as shown in FIG. 3A, the tank internal pressure Pt starts to be reduced toward the atmospheric pressure after the time t4.

Time t5 is a time when the tank internal pressure Pt shown by the solid line in FIG. 3A is reduced to the atmospheric pressure. Time t6 is a time when the tank internal pressure Pt shown by the single dot dashed line in FIG. 3A is reduced to the atmospheric pressure. Reference numeral Tw1 denotes a waiting time when the tank internal pressure Pt is controlled as shown by the solid line, while reference numeral Tw2 denotes a waiting time when the tank internal pressure Pt is controlled as shown by the single dot dashed line, during the operation of the internal combustion engine.

As is clear from the timing charts shown in FIGS. 3A through 3C, the waiting time Tw1 when the tank internal pressure Pt is controlled as shown by the solid line is sufficiently shorter than the waiting time Tw2 when the tank internal pressure Pt is controlled as shown by the single dot dashed line. Thus, provided that the device according to the present embodiment appropriately opens or closes the sealing valve 28 synchronously with the performance of the purge during the operation of the internal combustion engine, the waiting time that occurs before the refueling can be significantly reduced compared with the one generated where the sealing valve 28 is always closed.

Further, in the device according to the present embodiment, the sealing valve 28 is allowed to be open only when the purge is performed under a situation where the internal combustion engine is operated. Thus, the amount of fuel adsorbed by the canister 26 when the tank internal pressure Pt is controlled to the value shown by the solid line in FIG. 3A becomes substantially equal to the same adsorbed by the canister 26 when the tank internal pressure Pt is controlled to the value shown by the single dot dashed line in FIG. 3A. Therefore, the device according to the present embodiment allows the canister 26 to always ensure large fuel adsorption space therein without requiring an unnecessarily large capacity thereof, thereby effectively preventing the evaporated fuel from being released into the atmosphere associated with the refueling.

Figure 4:
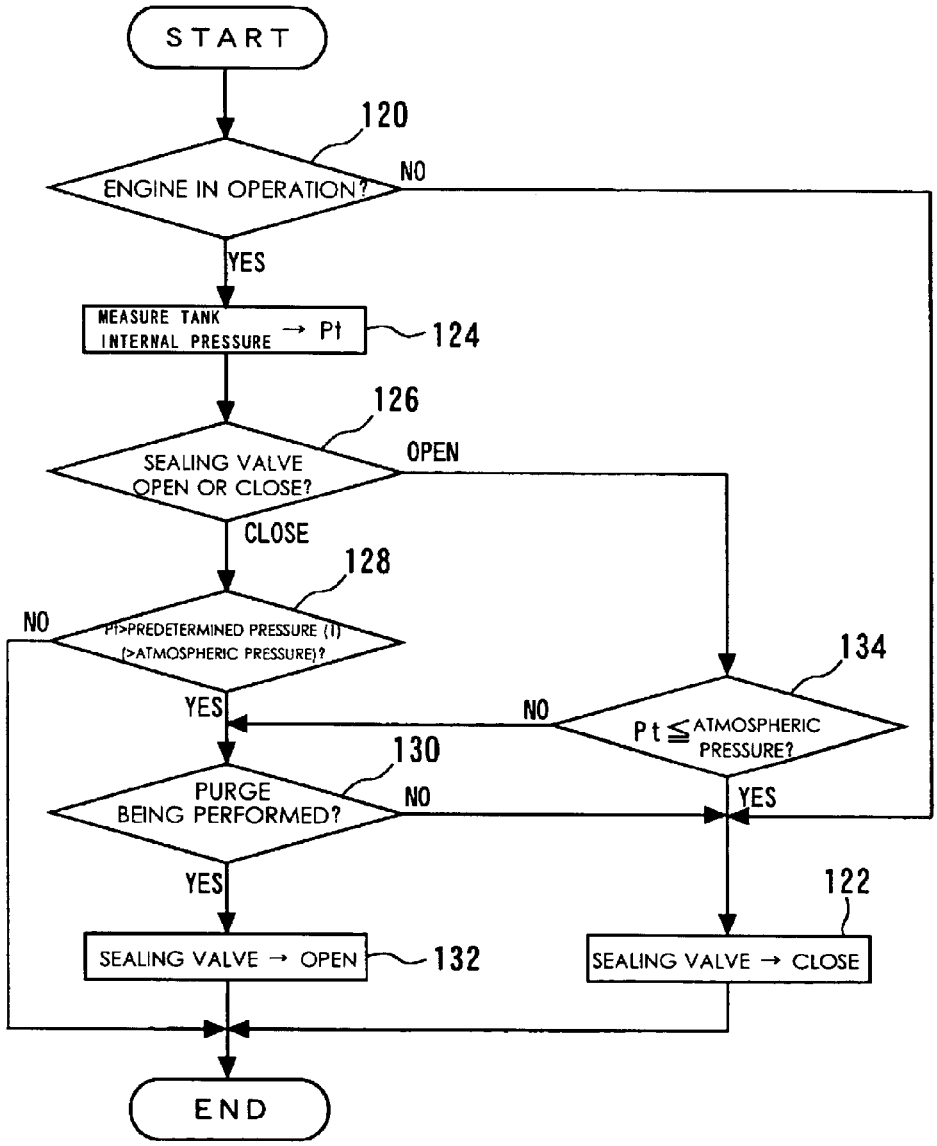
FIG. 4 is a flowchart of a routine performed for controlling a state of a sealing valve by the device according to the first embodiment of the present invention.

FIG. 4 is a flowchart of a control routine performed by the ECU 60 for achieving the above described function. In this routine shown in FIG. 4, it is first determined whether the internal combustion engine is in operation (Step 120). If it is determined that the internal combustion engine is not in operation, assumed that the vehicle is being parked, a processing of closing the sealing valve 28 is performed (Step 122).

On the other hand, when it is determined in Step 120 that the internal combustion engine is in operation, assumed that the vehicle is running, the tank internal pressure Pt at this time is measured (Step 124).

Then, it is determined whether the sealing valve 28 is now opened or closed (Step 126).

If a judgment is made that the sealing valve 28 is closed, it is then determined whether the tank internal pressure Pt is higher than the predetermined pressure (1) (>atmospheric pressure) (Step 128).

In a case where a judgment is made that the tank internal pressure Pt is not higher than the predetermined pressure (1), it is possible to determine that there is no need to open the sealing valve 28. In this case, the current processing cycle is finished immediately. On the other hand, when a judgment is made that the tank internal pressure Pt is higher than the predetermined pressure (1), a determination is further made whether the purge of the evaporated fuel is performed (Step 130).

When a judgment is made in Step 130 that the purge is not performed, it can be determined that if the sealing valve 28 opens in this state, the canister 26 adsorbs the evaporated fuel emitted from the fuel tank 10. In this case, the processing of Step 122, that is, the processing of closing the sealing valve 28 is performed in order to avoid such adsorption of the evaporated fuel.

On the other hand, when a judgment is made in Step 130 that the purge of the evaporated fuel is performed, it can be determined that the canister 26 does not adsorb the evaporated fuel even if the sealing valve 28 opens and the evaporated fuel is emitted from the fuel tank 10. Thus, in this case, the sealing valve 28 is opened in order to prevent an increase in the waiting time before the current processing cycle is finished (Step 132).

In the routine shown in FIG. 4, if a judgment is made in Step 126 that the sealing valve 28 is open, it is further determined whether the tank internal pressure Pt is reduced to the atmospheric pressure or lower (Step 134).

When it is determined that the tank internal pressure Pt is not reduced to the atmospheric pressure or lower, it can be determined that the sealing valve 28 should be kept open unless the purge is turned off. In this case, the processing after Step 130 are performed.

On the other hand, when a judgment is made in Step 134 that the tank internal pressure Pt is already reduced to the atmospheric pressure or lower, the processing of Step 122, that is, the processing of closing the sealing valve 28 is performed in order to avoid excessive emission of the evaporated fuel, and then the current processing cycle is finished.

According to the routine shown in FIG. 4, the sealing valve 28 can be appropriately opened/closed synchronously with the performance of the purge in an area where the tank internal pressure Pt is positive, during the operation of the internal combustion engine. More specifically, control can be performed to keep the tank internal pressure Pt between the atmospheric pressure and the predetermined pressure (1) synchronously with the performance of the purge, during the operation of the internal combustion engine. Thus, the device according to the present embodiment can control the tank internal pressure Pt to a value near the atmospheric pressure, with sufficient fuel adsorption space being always left in the canister 26, and sufficiently reduce the waiting time before the refueling while achieving good emission properties, using the canister 26 with a small capacity.

Second Embodiment

Next, a second embodiment of the present invention will be described with reference to FIGS. 5 and 6. An evaporated fuel treatment device according to this embodiment can be achieved by modifying the device according to the first embodiment such that the ECU 60 performs the below described routine shown in FIG. 6 instead of the routine shown in FIG. 4.

The device according to the first embodiment always allows the opening of the sealing valve 28 if the purge is performed when the tank internal pressure Pt is high. However, in a state where the tank internal pressure Pt is sufficiently high and a purge flow rate is low, opening the sealing valve 28 to release the tank internal pressure Pt causes a large amount of evaporated fuel to be adsorbed by the canister 26 without being purged into the intake passage 38.

In order to always keep a small amount of fuel adsorbed in the canister 26 thereby preparing for the refueling, the amount of fuel adsorbed by the canister 26 is desirably reduced as much as possible. Thus, the device according to the present embodiment does not allow the opening of the sealing valve 28 in a state where the purge flow rate is low and a large amount of evaporated fuel is expected to be adsorbed by the canister 26, whereas allowing the opening of the sealing valve 28 only when a sufficient purge flow rate is obtained.

Figure 5:
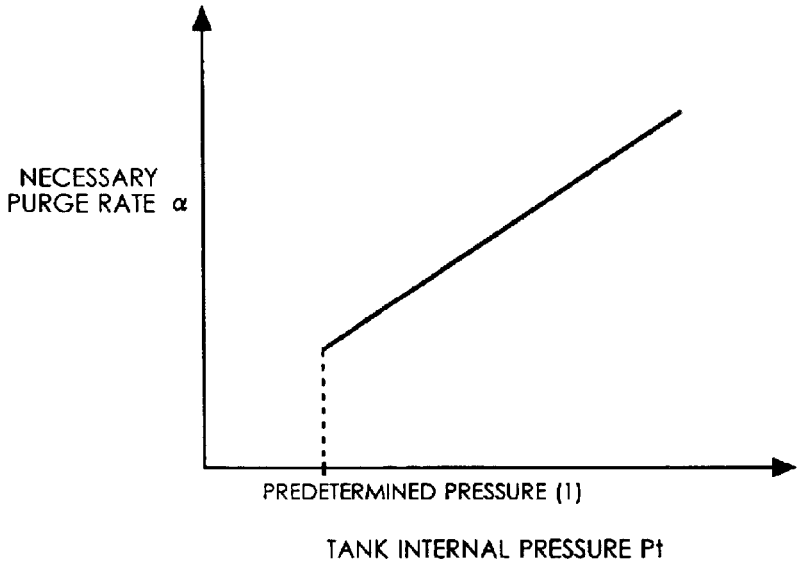
FIG. 5 is a drawing illustrating a relationship between tank internal pressure Pt and necessary purge rate $\alpha$ employed in a second embodiment of the present invention.

FIG. 5 illustrates in detail the state where the device according to the present embodiment allows the opening of the sealing valve 28. In FIG. 5, the horizontal axis shows the tank internal pressure Pt, and the vertical axis shows purge rate $\alpha$ necessary for flowing substantially all of the evaporated fuel emitted from the fuel tank 10 of the tank internal pressure Pt into the intake passage 38 of the internal combustion engine.

As described above, the device according to the present embodiment provides the appropriate degree of opening to the purge VSV 36 during the operation of the internal combustion engine to purge the evaporated fuel in the canister 26 into the intake passage 38. In order to achieve a desired air-fuel ratio in the state where the evaporated fuel in the canister 26 is purged, it is necessary to correct the amount of injected fuel so as to remove the amount of fuel supplied by purging from the amount of injected fuel. For convenience of the correction, the device according to the present embodiment introduces a concept of a purge rate PGR to control the purge VSV 36.

The purge rate PGR is a ratio of quantity of a gas flowing into the intake passage 38 through the purge VSV 36 (quantity of purge QPG) to the amount of air flowing into the intake passage 38 (amount of intake air Ga), i.e., QPG/Ga. The quantity of purge QPG is a value uniquely determined by the degree of opening of the purge VSV 36 and intake pipe pressure Pm. The device according to the present embodiment sets a target purge rate PGR depending on operation states of the internal combustion engine, and controls the degree of opening of the purge VSV 36 based on the amount of intake air Ga and the intake pipe pressure Pm so as to achieve the target.

In the present embodiment, the ECU 60 stores a map which defines a relationship shown in FIG. 5, that is, a relationship between the purge rate $\alpha$ necessary for flowing substantially all of the evaporated fuel emitted from the fuel tank 10 when the sealing valve 28 opens into the intake passage 38, and the tank internal pressure Pt. The ECU 60 determines whether opening the sealing valve 28 or not depending on whether the actual purge rate PGR exceeds the necessary purge rate $\alpha$.

Figure 6:
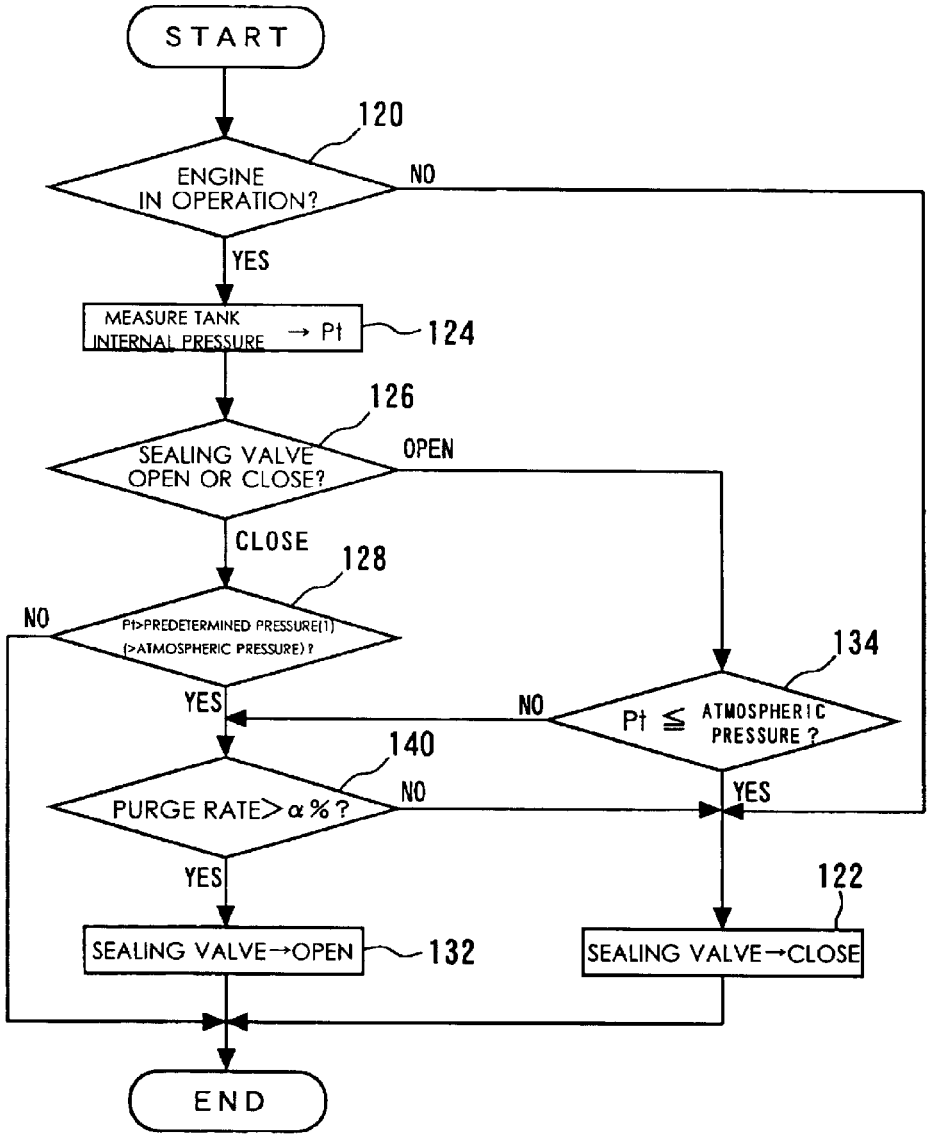
FIG. 6 is a flowchart of a routine performed for controlling a state of a sealing valve by the device according to the second embodiment of the present invention.

FIG. 6 is a flowchart of a control routine performed by the ECU 60 in this embodiment for achieving the above described function. In FIG. 6, like reference numerals denote like steps as in FIG. 4, and descriptions thereof will be omitted or simplified.

The routine shown in FIG. 6 is the same as the routine shown in FIG. 4 except that Step 140 replaces Step 130. Specifically, in the routine shown in FIG. 6, when a judgment is made in Step 128 that the tank internal pressure Pt is higher than the predetermined pressure (1), or when a judgment is made in Step 134 that the tank internal pressure Pt is not reduced to the atmospheric pressure, it is then determined whether the purge rate PGR exceeds the necessary purge rate $\alpha$ (Step 140). The necessary purge rate $\alpha$ used herein is a value set by the ECU 60 based on the output of the tank internal pressure sensor 12 (tank internal pressure Pt) according to the map that defines the relationship shown in FIG. 5.

When it is determined in Step 140 that the purge rate PGR exceeds the necessary purge rate $\alpha$, the processing of Step 132 is performed to open the sealing valve. On the other hand, when it is determined that the purge rate PGR does not exceed the necessary purge rate $\alpha$, the processing of Step 122 is performed to close the sealing valve 28.

According to the above described processing, the sealing valve 28 opens only when the purge rate PGR is sufficient to flow all of the evaporated fuel, expected to be emitted from the fuel tank 10, into the intake passage 38. Thus, the device according to the present embodiment can keep the tank internal pressure Pt between the atmospheric pressure and the predetermined pressure (1) without further evaporated fuel being adsorbed by the canister 26, during the running of the vehicle, and thereby effectively preventing the fuel from blowing through the canister 26 during the refueling.

In the second embodiment described above, it is determined whether substantially all of the evaporated fuel emitted from the fuel tank 10 is flown into the intake passage 38 without being adsorbed by the canister 26, depending on whether the purge rate PGR exceeds the necessary purge rate $\alpha$. However, the determination method is not limited to this. Specifically, the determination may be made depending on whether the quantity of purge QPG is sufficient to purge all of the evaporated fuel, expected to be emitted from the fuel tank 10. The determination may be made based on the quantity of purge QPG instead of the purge rate PGR.

Third Embodiment

Next, a third embodiment of the present invention will be described with reference to FIG. 7. An evaporated fuel treatment device according to this embodiment can be achieved by the ECU 60 performing the routine shown in FIG. 6 after the necessary purge rate α described in the second embodiment is changed to the below described valve opening allowance purge rate β. According to the routine thus corrected, the sealing valve 28 can open only when the purge rate PGR exceeds the valve opening allowance purge rate β.

The device according to the present embodiment unlocks the lid 68 after the fuel tank 10 is decompressed when the lid switch 62 is operated, like the device according to the first embodiment. In order to shorten the waiting time occurring at this time, it is effective to keep the tank internal pressure Pt near the atmospheric pressure as described above.

For keeping the tank internal pressure Pt near the atmospheric pressure, it is effective to increase opening frequency of the sealing valve 28 as the tank internal pressure Pt being higher. In order to increase the opening frequency of the sealing valve 28, it is effective to reduce the valve opening allowance purge rate β, that is, a minimum purge rate PGR that allows the opening of the sealing valve 28.

Figure 7:
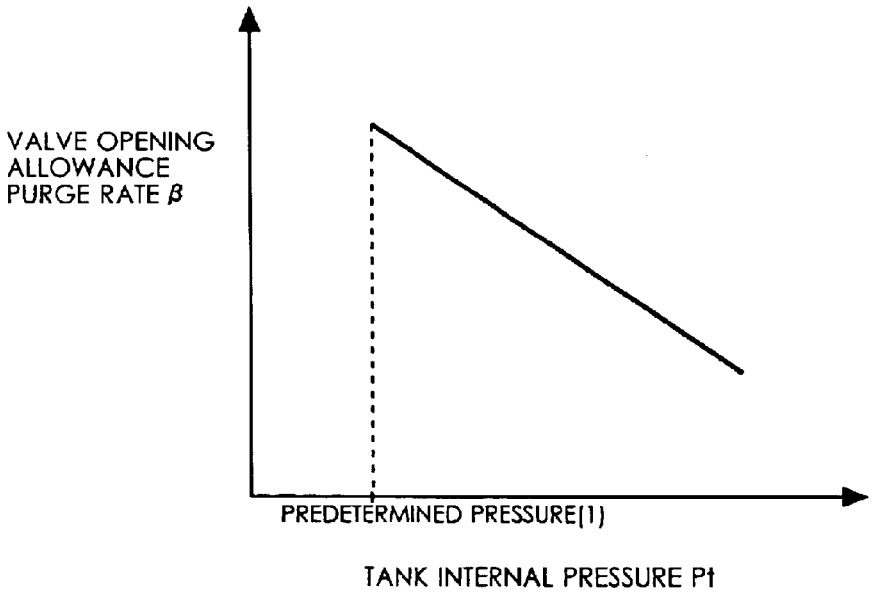
FIG. 7 is a drawing illustrating a relationship between tank internal pressure Pt and valve opening allowance purge rate $\beta$ employed in a third embodiment of the present invention.

FIG. 7 shows a relationship between the valve opening allowance purge rate β and the tank internal pressure Pt used in the present embodiment. In this embodiment, the ECU 60 stores a map that defines the relationship shown in FIG. 7, and sets, in a step corresponding to Step 140 in a correction routine of the routine shown in FIG. 6, the valve opening allowance purge rate β according to the map. Then, when the condition of PGR>β is satisfied, the sealing valve 28 opens (see Step 132), and when the condition is not satisfied, the sealing valve 28 closes (see Step 122).

As shown in FIG. 7, the valve opening allowance purge rate β becomes smaller for higher tank internal pressure Pt. Thus, the device according to the present embodiment can provide higher opening frequency of the sealing valve 28 as the tank internal pressure Pt becomes higher, thereby being able to control the tank internal pressure Pt to the value near the atmospheric pressure accurately during the running of the vehicle.

The device according to the present embodiment can prohibit the opening of the sealing valve 28 in a state where the purge is performed at a purge rate PGR lower than the valve opening allowance purge rate β. Thus, the device according to the present embodiment advantageously restrains the amount of evaporated fuel further adsorbed by the canister 26 during the running of the vehicle.

In the third embodiment described above, it is determined whether the opening of the sealing valve 28 is allowed depending on whether the purge rate PGR exceeds the valve opening allowance purge rate β, but the determination method is not limited to this. Specifically, the determination may be made based on the quantity of purge QPG instead of the purge rate PGR as in the second embodiment.

Fourth Embodiment

Figure 8:
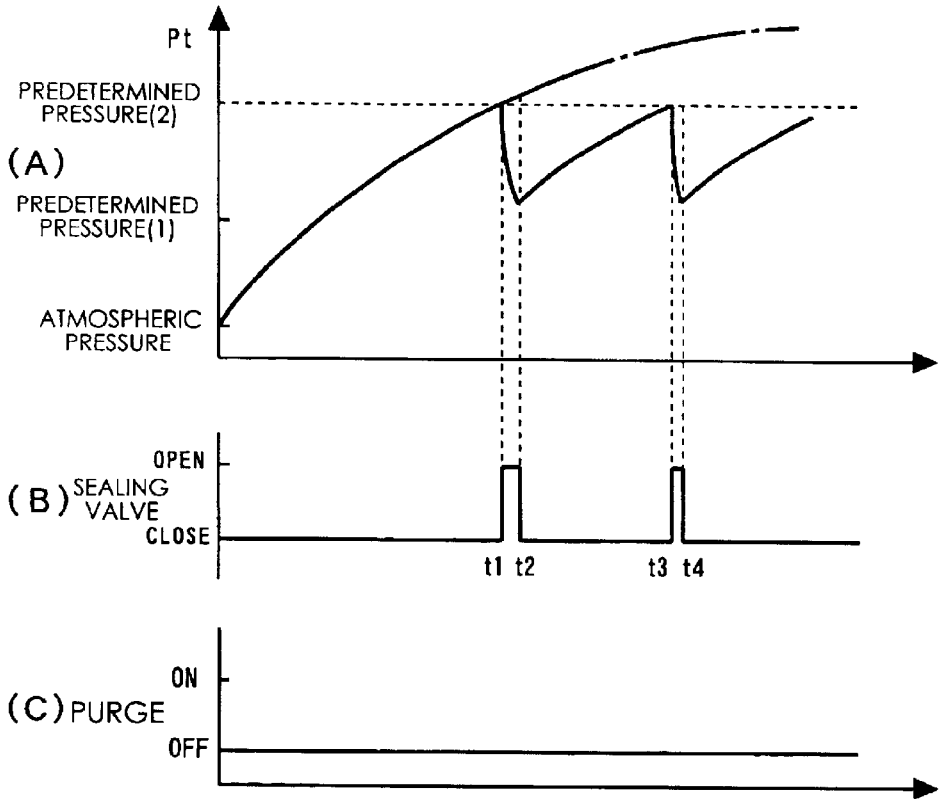
FIGS. 8A through 8C are timing charts for describing an operation of the device according to a fourth embodiment of the present invention.

Next, a fourth embodiment of the present invention will be described with reference to FIGS. 8 and 9. An evaporated fuel treatment device according to this embodiment can be achieved by modifying the device according to any one of the first embodiment through the third embodiment such that the ECU 60 performs the below described routine shown in FIG. 8 instead of the routine shown in FIG. 4 or 6.

The device according to any one of the first embodiment through the third embodiment allows the opening of the sealing valve 28 only when the predefined purge is performed during the running of the vehicle, in order to reduce the amount of fuel adsorbed by the canister 26. In such a device, if the predefined purge is not performed for a long time, the tank internal pressure Pt may become significantly higher than the predetermined pressure (1).

When the tank internal pressure Pt is high as described above, an excessively long waiting time occurs before the refueling, which may give an uncomfortable feeling to the user of the vehicle. Thus, in such a state, specifically, in a state where the tank internal pressure Pt exceeds predetermined pressure (2) significantly higher than the predetermined pressure (1), the device according to the present embodiment forces the sealing valve 28 to be open without consideration of synchronization with the purge.

FIGS. 8A though 8C are timing charts for illustrating an operation of the device according to the present embodiment during the running of the vehicle. More specifically, FIG. 8A shows a comparison between the tank internal pressure Pt (the solid line) achieved by the sealing valve 28 being forced to be opened, and the tank internal pressure Pt (the single dot dashed line) achieved when the sealing valve 28 is always closed. FIG. 8B shows an opening/closing state of the sealing valve 28. Further, FIG. 8C shows a performing state of the purge.

As shown in the drawing, the device according to the present embodiment forces the sealing valve 28 to be open at a time when the tank internal pressure Pt reaches the predetermined pressure (2) as a result that the purge is turned off for a long time (times t1, t3). When the sealing valve 28 opens, the tank internal pressure Pt is reduced. When the tank internal pressure Pt becomes lower than the predetermined pressure (2) in the state where the purge is turned off, as the sealing valve 28, the tank internal pressure Pt starts increasing again after. Thereafter, such a valve opening processing is repeated as long as purge cutting is continued, thereby the tank internal pressure Pt is kept at the predetermined pressure (2) or lower.

Figure 9:
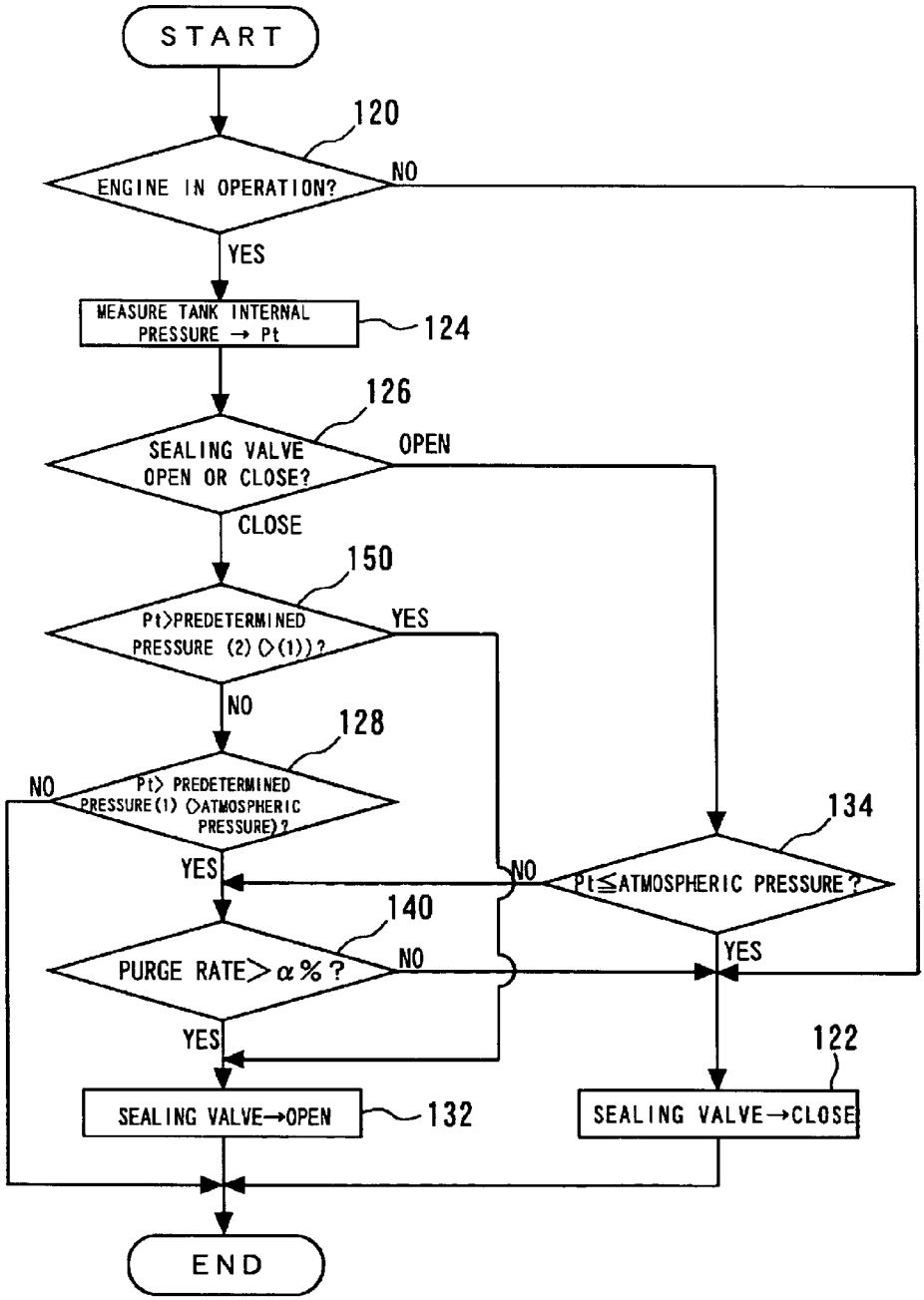
FIG. 9 is a flowchart of a routine performed for controlling a state of a sealing valve by the device according to the fourth embodiment of the present invention.

FIG. 9 is a flowchart of a control routine performed by the ECU 60 in this embodiment for achieving the above described function. In FIG. 9, like reference numerals denote like steps as in FIG. 4 or 6, and descriptions thereof will be omitted or simplified.

The routine shown in FIG. 9 is the same as the routine shown in FIG. 6 except that Step 150 is inserted between Step 126 and Step 128. That is, in the routine shown in FIG. 9, when a judgment is made in Step 126 that the sealing valve 28 is closed, it is determined whether the tank internal pressure Pt is higher than the predetermined pressure (2) (>the predetermined pressure (1)) set as forced valve opening pressure (Step 150).

When it is determined that the tank internal pressure Pt is not higher than the predetermined pressure (2), the processing after Step 128 are thereafter performed. In this case, the sealing valve 28 is controlled as in the second embodiment, thereby the tank internal pressure Pt is kept near the atmospheric pressure as in the second embodiment.

On the other hand, when it is determined in Step 150 that the tank internal pressure Pt is higher than the predetermined pressure (2), the sealing valve 28 immediately opens in Step 132 regardless of the state of the purge thereafter. When the sealing valve 28 opens, the gas in the fuel tank 10 is released into the canister 26 to reduce the tank internal pressure Pt.

In a processing cycle immediately after the sealing valve 28 is forced to be open, a judgment is made in Step 126 that the sealing valve 28 is open. In this case, the processing of Step 134 is then performed, and a judgment is made herein that the tank internal pressure Pt is not lower than the atmospheric pressure. Thus, it is then determined in Step 140 whether the purge rate PGR is equal to or larger than the necessary purge rate α. When the purge is continuously turned off, it is determined that this condition is not satisfied, and the sealing valve 28 closes in Step 122.

As described above, according to the routine shown in FIG. 9, it is possible to reduce the tank internal pressure Pt below the predetermined pressure (2) by temporarily opening the sealing valve 28 when the tank internal pressure Pt becomes higher than the predetermined pressure (2) as a result of the purge cutting continuing for a long time. At this time, since the sealing valve 28 opens temporarily before closes immediately, the amount of evaporated fuel flowing into the canister 26 is effectively minimized. Therefore, according to the routine shown in FIG. 9, even if the purge is turned off for a long time during the running of the vehicle, an excessive increase in the tank internal pressure Pt can be prevented without a significant increase in the amount of fuel adsorbed in the canister 26. Thus, the device according to the present embodiment can prevent the evaporated fuel from blowing through the canister 26, and prevent occurrence of the excessively long waiting time, even when the refueling is performed after the purge cutting is continued for a long time.

The major benefits of the present invention described above are summarized as follows:

According to a first aspect of the present invention, the sealing valve is opened or closed depending on whether the predefined purge is performed, during the operation of the internal combustion engine in the area where the tank internal pressure is positive. When the predefined purge is performed, the evaporated fuel emitted from the fuel tank as the sealing valve opens flows into the intake passage without being adsorbed in the canister. Thus, according to the present invention, the tank internal pressure is kept near the atmospheric pressure without increasing the amount of fuel adsorbed in the canister during the operation of the internal combustion engine. As a result, it is possible to achieve good emission properties using the canister with the small capacity as well as to sufficiently reduce the waiting time before the refueling.

According to a second aspect of the present invention, the opening of the sealing valve is allowed only when the characteristic value of the quantity of purge exceeds the predetermined determination value, that is, when the sufficient purge is performed. Thus, according to the present invention, the amount of evaporated fuel adsorbed by the canister associated with the opening of the sealing valve can be sufficiently restrained.

According to a third aspect of the present invention, required quantity of the purge for satisfying an opening condition of the sealing valve increases as the amount of evaporated fuel expected to be emitted becomes larger as the tank internal pressure becomes higher. Thus, the present invention can effectively prevent the canister from adsorbing the evaporated fuel emitted from the fuel tank associated with the opening of the sealing valve.

According to a fourth aspect of the present invention, the opening condition of the sealing valve becomes easy to be satisfied as the waiting time expected to arise before the refueling becomes longer as the tank internal pressure becomes higher. Thus, the present invention can always sufficiently shorten the waiting time before the refueling.

According to a fifth aspect of the present invention, when the tank internal pressure exceeds the maximum allowable limit positive pressure value, the sealing valve is forced to be open. Thus, the present invention can reliably prevent the tank internal pressure from exceeding the maximum allowable limit positive pressure value.

Further, the present invention is not limited to these embodiments, but variations and modifications may be made without departing from the scope of the present invention. The entire disclosure of Japanese Patent Application No. 2002-321688 filed on Nov. 11, 2002 including specification, claims, drawings and summary are incorporated herein by reference in its entirety.

What is claimed is:

1. An evaporated fuel treatment device of an internal combustion engine comprising:

a vapor passage that makes communication between a fuel tank and a canister;

a purge passage that makes communication between said canister and an intake passage of the internal combustion engine;

a sealing valve that controls a communication state of said vapor passage;

a purge control valve that controls a communication state of said purge passage;

tank internal pressure detection means that detects tank internal pressure;

purge control means that controls said purge control valve to flow evaporated fuel into said intake passage during operation of the internal combustion engine; and sealing valve synchronization control means that opens or closes said sealing valve depending on whether a predefined purge is performed in an area where said tank internal pressure is positive.

2. The evaporated fuel treatment device of an internal combustion engine according to claim 1, further comprising purge characteristic value detection means that detects a characteristic value of quantity of purge flowing into said intake passage through said purge passage, wherein said sealing valve synchronization control means includes characteristic value determination means that determines whether said predefined purge is performed depending on whether the characteristic value of said quantity of purge exceeds a predetermined determination value.

3. The evaporated fuel treatment device of an internal combustion engine according to claim 2, wherein said sealing valve synchronization control means includes first determination value setting means that sets said predetermined determination value to a larger value as said tank internal pressure becomes higher.

4. The evaporated fuel treatment device of an internal combustion engine according to claim 2, wherein said sealing valve control synchronization means includes second determination value setting means that sets said predetermined determination value to a smaller value as said tank internal pressure becomes higher.

5. The evaporated fuel treatment device of an internal combustion engine according to claim 1, further comprising sealing valve forced opening means that opens said sealing valve regardless of an instruction of said sealing valve synchronization control means, when said tank internal pressure exceeds a maximum allowable limit positive pressure value.

* * * * *